US005291299A

United States Patent [19]

Karna

[11] Patent Number: 5,291,299

[45] Date of Patent: Mar. 1, 1994

[54] POWER SUPPLY AND CONTROL UNIT FOR A LIGHT SYSTEM AND A LIGHTING UNIT FOR THE LIGHT SYSTEM

[75] Inventor: Juhani Karna, Tampere, Finland

[73] Assignee: Idman Oy, Mantsala, Finland

[21] Appl. No.: 846,324

[22] Filed: Mar. 6, 1992

[30] Foreign Application Priority Data

Mar. 7, 1991 [FI] Finland ..... 911154

[51] Int. Cl.[5] ..... H05B 37/00

[52] U.S. Cl. ..... 315/323; 315/360; 315/361; 315/362

[58] Field of Search ..... 315/323, 360, 361, 362, 315/149, 156, 159

[56] References Cited

U.S. PATENT DOCUMENTS

| | | | |
|---|---|---|---|
| 4,090,107 | 5/1978 | Seib | 315/361 |
| 4,422,018 | 12/1983 | Bailey | 315/360 |
| 5,150,012 | 9/1992 | Pringle et al. | 315/360 |

OTHER PUBLICATIONS

"Direct Line Coupled Sequenced Flashing Lights System" brochure published by ADB Aviation Lighting Systems Leuvensesteenweg 585, B1903 Zaventem, Belgium (four pages).

*Primary Examiner*—Robert J. Pascal
*Assistant Examiner*—R. A. Ratliff
*Attorney, Agent, or Firm*—Cushman, Darby & Cushman

[57] ABSTRACT

The invention relates to a power supply and control unit for a light system, especially an airport approach light system, for making a number of lights go on and out as a progressive light front. The invention is also concerned with a lighting unit (1) suitable for use in combination with this power supply and control unit. To minimize the need for cable laying especially for the light system, the power supply and control unit comprises means (2) for generating clock pulses (b) occurring at a frequency proportional to the rate of progression of the light front; means (3) for generating a control signal (c) comprising recurrent sequences containing a predetermined number of control pulses corresponding to the frequency of the clock pulses and a subsequent portion comprising no control pulses and having a duration equal to one or more cycle times corresponding to the frequency of the clock pulses; and a power stage (4) which is arranged to receive the control signal (c) and a supply (s) from a source of power and to generate at its output voltage pulses (v) in response to the control pulses of the control signal on the basis of said control signal and supply.

10 Claims, 1 Drawing Sheet

POWER SUPPLY AND CONTROL UNIT FOR A LIGHT SYSTEM AND A LIGHTING UNIT FOR THE LIGHT SYSTEM

BACKGROUND OF THE INVENTION

1. Field of the Invention

This invention relates to a power supply and control unit for a light system, especially an airport approach light system, for making a number of lights go on and out as a progressive light front. The invention is also concerned with a lighting unit for use in combination with the above-mentioned power supply and control unit.

2. Description of the Related Art

A conventional airport approach light system comprises several, e.g. about 20, lights in line with each other and arranged to light up as a progressive front so that practically only one light at a time is on and the direction of the runway is indicated by the order in which the lights go on. Traditionally, this kind of system has required plenty of cable laying both for the power supply and control of the lights and for the synchronization of their operation.

SUMMARY OF THE INVENTION

The object of the present invention is to provide a power supply and control unit for a light system of this type, in which the need for cable laying is minimized. This is achieved by means of a power supply and control unit according to the invention, which is characterized in that it comprises means for generating clock pulses occurring at a frequency proportional to the rate of progression of the light front;

means for generating a control signal comprising recurrent sequences containing a predetermined number of control pulses corresponding to the frequency of the clock pulses and a subsequent portion comprising no control pulses and having a duration equal to one or more cycle times corresponding to the frequency of the clock pulses; and a power stage which is arranged to receive the control signal and a supply from a source of power and to generate at its output voltage pulses in response to the control pulses of the control signal on the basis of said control signal and supply.

Thus the supply and control units applies a single signal which comprises voltage pulses and a portion with no voltage pulses, the total length of this sequence corresponding to one operating cycle of the light system.

Only the twin cable has to be drawn to the lighting units of the light system, the lighting units being connected in parallel to the cable. By means of the energy and information supplied through the cable, the lighting units are able to light up and go out in time. To achieve this operation, a lighting unit according to the invention, comprising a lamp, such as a xenon lamp, and a triggering circuit for lighting the lamp when the supply voltage of the lighting unit is connected across the lamp, is characterized in that the supply voltage of the lighting unit comprises recurrent sequences containing a predetermined number of voltage pulses and a subsequent portion with no voltage pulses and having a duration equal to one or more cycle times corresponding to the frequency of the voltage pulses.

The lighting unit comprises:

counting means for counting the pulses of the supply voltage and for generating a control signal when the reading of the counting means reaches a reading preset in the counting means, a logic circuit which is arranged to respond to the control signal from the counting means and to apply a triggering signal to a triggering circuit for lighting the lamp; and means for detecting the portion with no voltage pulses in the supply voltage of the lighting unit and for applying a resetting signal to the counting means on detecting such a portion.

With these components, the lighting unit is able to both obtain sufficiently energy from the voltage pulse sequence it has received to light the associated lamp, and count the pulses in the voltage pulse sequence to pick up the pulse by which it is to be lit.

BRIEF DESCRIPTION OF THE DRAWINGS

In the following, a power supply and control unit according to the invention and a lighting unit for a light system, intended to operate in combination with the power supply and control unit, will be described in more detail with reference to the attached drawings, in which.

DETAILED DESCRIPTION OF THE PREFERRED EMBODIMENTS

Figure 1:
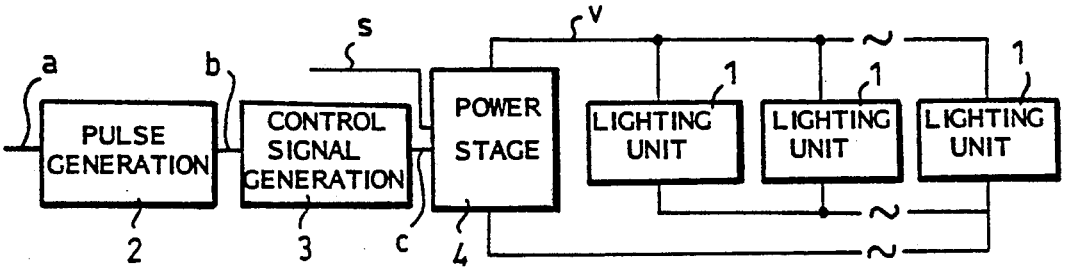
FIG. 1 shows a block diagram of a light system according to the invention.

FIG. 1 shows a block diagram of a light system by means of which lamps contained in lighting units 1 can be lit up and put out to obtain a progressive light front. For this purpose, the light system comprises a power supply and control unit which comprises the blocks 2, 3, and 4 shown in FIG. 1. The block 2 thereby generates clock pulses at a desired frequency, and the block 3 generates a control signal from the clock signals, the control signal comprising a portion of desired length with control pulses and a portion of desired length with no control pulses. The control signal, in turn, controls a power stage 4 producing supply voltage for the lighting units 1. In the block diagram of FIG. 1, the block 2 generating the clock pulses is shown to receive a signal a which may be, e.g., line voltage, and so the frequency of the clock pulses generated by it can be synchronized with the line frequency in a simple manner. The clock pulse synchronized with the line may be used especially is cases where the power stage 4 comprises line-commutated components, such as thyristors. On the contrary, if the power stage 4 utilizes gate-commutated components, such as GTO thyristors or power transistors, it is also possible to use other clock pulse frequencies. A clock pulse sequence b generated by the block 2 is applied to the block 3, which generates a control signal c from it for the power stage 4. The block 3 contains e.g. a counter which counts the clock pulses b and by means of which a desired operating cycle length can be set. The block 3 further comprises a logic circuit which forms the portion with no control pulses in each sequence, the duration of the portion being e.g. two or three clock pulse cycles. This logic circuit also resets the counter after the portion with no control pulses. If required, the block 3 also comprises means for shaping, e.g. amplifying, the generated cyclic signal into a control signal c suitable for controlling the components of the power stage 4. As already mentioned above, the power stage 4 receives the control signal c and a line supply s, which may be e.g. a single-phase or three-phase line voltage or direct voltage. The power stage comprises controllable semiconductor switch components, such as thyristors or GTO thyristors or power transistors, by means of which voltage pulses are generated from the supply voltage s in accordance with the control signal c. With the single-phase supply, the power stage may thus be a single-pulse converter, and with the three-phase supply, if only conductors of two phases are used, it may be a single-way-two-pulse converter. The output signal of the power stage 4 comprises recurrent sequences which contain a predetermined number of voltage pulses and a subsequent portion with no voltage pulses, the total length of the voltage pulses and the pulseless portion corresponding to the cycle of the control signal c. Depending on the supply voltage of the power stage 4, the voltage pulses may be formed e.g. of the positive half waves of the single-phase voltage or the successive positive half waves of two phase voltages of the three-phase supply, whereby the operation of the xenon lamps contained in the lighting units 1 and the current obtained by them are more readily controllable.

As appears from FIG. 1, the power supply from the power stage to the lighting units 1 is, in principle, bipolar. However, the lighting units 1 are connected in parallel in such way that their negative poles are coupled together and drawn to the remotest lighting unit 1 before a return conductor is drawn to the power stage 4. In this way the supply conductors of all the lighting units are equal in length, and so the resistance of the conductor supplying the lighting unit will also be constant. Thus the current obtained by the lighting units when the lamps light up is constant, so that their luminosities are also equal.

The lighting units 1 are thus able to count the pulses in the voltage pulse sequence supplied by the power stage so as to find the position in which they are to light up, and to obtain the power required for lighting the lamp from this voltage pulse sequence, in addition to which the length of the operating cycle of the light system and the luminosity of its lighting units can be adjusted by means of the power stage 4. The length of the operating cycle is directly adjustable by adjusting the counter contained in the block 3. The luminosity, in turn, can be adjusted conventionally by varying the resistance of the conductor supplying the lighting unit by means of an additional resistor. Furthermore, it is possible to provide the power stage with means for monitoring whether or not one of the lighting units has lit up at each voltage pulse of the supply voltage. This can be effected by means of a current transformer or a similar device included in the power stage and operating in response to the current obtained by the lighting unit. If the lighting unit does not light up, it does not either substantially take current from the power stage 4. In this way, it is possible to detect e.g. the blowing of a lamp in one of the lighting units 1 or if the lamp fails to light up for some other reason.

Figure 2:
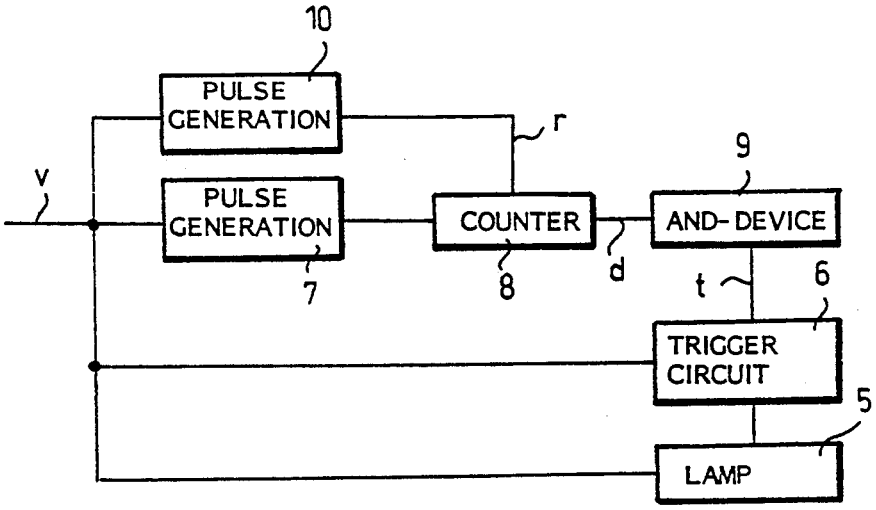
FIG. 2 shows a block diagram of a lighting unit included in the system shown in FIG. 1.

FIG. 2 is a more detailed block diagram of the structure of the lighting unit 1. The voltage pulse sequence from the power stage 4 shown in FIG. 1 is indicated by the signal v. This voltage pulse sequence v is applied to the counting means, formed of the blocks 7 and 8, to a triggering circuit 6, a lamp 5, and means 10 which are arranged to reset the counter 8 of the counting means. When the voltage pulses v reach the block 7, pulses are generated from them in the block by means of e.g. a saw-tooth generator and a comparator, the pulses being counted by the counter 8. The reading at which the particular lighting unit is to light up is preset in the counter 8. When this reading is achieved in the counter 8, the counter produces an output signal d which is applied to a logic circuit 9 which may be e.g. an AND device which generates a triggering pulse t at its output for the triggering circuit 6 on receiving the right pulses from the counter 8. This triggering circuit may be a conventional triggering circuit suitable for controlling xenon lamps, and it may comprise e.g. a thyristor which opens on receiving the signal t, allowing the supply voltage pulse v to be applied to a pulse transformer which, in turn, generates a high-voltage pulse required for lighting the lamp 5. On receiving this high-voltage pulse, the lamp 5, in turn, lights up, obtaining the current determined by its associated components from the supply voltage v applied across it. The lighting unit 1 further comprises means 10 for detecting the portion with no voltage pulses in the supply voltage v of the lighting unit for applying a resetting signal r to the counter 8 on detecting such a portion. In this way the counters of all the lighting units 1 can be reset simultaneously. Accordingly, they start a new counting upon the arrival of the first voltage pulse of a new period, and so the synchronization of the lighting units 1 with each other can be effected by merely presetting the counters 8, that is, the ordeal number of the voltage pulse at which each particular lighting unit should light up is preset in the counters 8. The means 10 may comprise e.g. a saw-tooth generator, and a comparator connected after it. The comparator is able to change its state and generate the resetting signal r at its output only when the level of the supply voltage remains below a predetermined level at least during two clock cycles. This operation can be easily effected by adjusting the charging time constant of the saw-tooth generator and the reference voltage level of the comparator.

The power supply and control unit for a light system and the lighting unit adapted for operation in combination with such a control unit have both been described above only by means of one exemplifying structural arrangement, and it is to be understood that numerous different structural arrangements effecting the defined operations can be provided, especially on the component level, without deviating from the scope of protection defined by the attached claims.

I claim:

1. A power supply and control apparatus for a sequenced flashing light system of predetermined frequency, not related to a system line frequency, for making a number of lights flash 'on' and 'off' as for an airport approach light system, said power supply and control apparatus comprising:

means for generating clock pulses occurring at a frequency proportional to said predetermined frequency of the progressive light front;

means for generating a control signal of recurrent sequences each comprising a first portion having a predetermined number of control pulses corresponding in frequency to the frequency of the clock pulses, and a subsequent portion comprising no control pulses but having a duration of at least one cycle which value also corresponds to the frequency of the clock pulses; and a power stage for receiving said control signal and a supply signal from a power source means coupled thereto and generating output pulses in response thereto.

2. The power supply and control apparatus of claim 11, wherein the duration of said subsequent portion having no pulses is at least two cycles.

3. The power supply and control apparatus of claim 1, wherein said means for generating a control signal comprises:

counter means for counting clock pulses and for setting the length of each first portion of a recurrent sequence;

logic means coupled to said counter means for generating each subsequent portion of a recurrent sequence and for resetting the counter means at the end thereof; and means for shaping the output signal from the logic means into a control signal of recurrent sequences before coupling it to the power stage.

4. The power supply and control apparatus of claim 1, wherein said supply voltage is one of a three-phase line voltage and a direct voltage.

5. The power supply and control apparatus of claim 2, wherein said supply voltage is one of a three-phase line voltage and a direct voltage.

6. The power supply and control apparatus of claim 2, wherein said means for generating a control signal comprises:

counter means for counting clock pulses and for setting the length of each first portion of a recurrent sequence;

logic means coupled to said counter means for generating each subsequent portion of a recurrent sequence and for resetting the counter means at the end thereof; and means for shaping the output signal from the logic means into a control signal recurrent sequence before coupling it to the power stage.

7. The power supply and control apparatus of claim 6, wherein said supply voltage is one of a three-phase line voltage and a direct voltage.

8. A lighting unit assembly for use with a sequenced flashing light system as for an airport approach light system, said lighting unit assembly including a lamp, such as a xenon lamp, and a triggering circuit for lighting the lamp in response to a supply voltage signal from the sequenced flashing light system, the supply voltage signal including recurrent sequences each comprising a first portion having a predetermined number of voltage pulses and a subsequent portion comprising no voltage pulses but having a duration of at least one cycle which value also corresponds to a frequency of the voltage pulses, this frequency not being related to a system line frequency, the lighting unit assembly further comprising:

counting means for counting clock pulses along each recurrent sequence in the supply voltage source signal and generating a control signal each time the count reaches a predetermined value;

logic means coupled to said counting means and responsive to said control signal for applying a triggering signal to the triggering circuit to light the lamp; and detecting means for detecting the subsequent portion of each recurrent sequence to reset the counting means.

9. The power supply and control apparatus of claim 8, wherein said supply voltage is one of a three-phase line voltage and a direct voltage.

10. The power supply and control apparatus of claim 8, wherein the duration of said subsequent portion having no pulses is at least two cycles.

* * * * *